United States Patent [19]

Clark et al.

[11] Patent Number: 4,466,607

[45] Date of Patent: Aug. 21, 1984

[54] SHEET INVERTING DEVICE

[75] Inventors: Albert R. Clark, McKinney; William A. Ernst, Irving; Svetislav Mitrovich, Dallas; James E. Self, Richardson, all of Tex.

[73] Assignee: The Mead Corporation, Dayton, Ohio

[21] Appl. No.: 355,422

[22] Filed: Mar. 8, 1982

[51] Int. Cl.[3] ..... B65H 5/00

[52] U.S. Cl. ..... 271/225; 271/DIG. 9; 271/183; 271/184; 271/188; 271/209; 271/231

[58] Field of Search ..... 271/225, 184, DIG. 9, 271/188, 209, 231, 182, 183

[56] References Cited

U.S. PATENT DOCUMENTS

| | | | |
|---|---|---|---|
| 2,087,997 | 7/1937 | Reinartz | 271/231 |
| 3,227,444 | 1/1966 | Egan | 271/65 |
| 3,273,886 | 9/1966 | Taylor | 271/DIG. 9 |
| 3,339,705 | 9/1967 | Burkhardt | 271/DIG. 9 |
| 3,408,140 | 10/1968 | Hemphill | 355/23 |
| 3,416,791 | 12/1968 | Beckman, Jr. et al. | 271/65 |
| 3,476,384 | 11/1969 | Thull | 271/188 X |
| 3,548,783 | 12/1968 | Knapp | 118/224 |
| 3,615,129 | 10/1971 | Drawe et al. | 355/3 |
| 3,672,765 | 6/1972 | Altmann | 355/24 |
| 3,856,295 | 12/1974 | Looney | 271/65 |
| 3,917,257 | 11/1975 | Caldwell | 271/65 |
| 3,942,785 | 3/1976 | Stange | 271/65 |
| 3,980,406 | 9/1976 | Lang | 355/24 |
| 4,040,616 | 8/1977 | Clarkson et al. | 271/65 |
| 4,052,128 | 10/1977 | Burton et al. | 355/77 |
| 4,054,285 | 10/1977 | Stange et al. | 271/186 |
| 4,111,547 | 9/1978 | Stemle . | |
| 4,190,354 | 2/1980 | Smith et al. | 355/3 |
| 4,204,672 | 5/1980 | Grivet | 271/188 |
| 4,214,740 | 7/1980 | Acquaiwa | 271/3 |
| 4,214,831 | 7/1980 | Reesen | 355/3 |
| 4,229,101 | 10/1980 | Hamlin et al. | 355/77 |
| 4,234,180 | 11/1980 | Looney | 271/3.1 |
| 4,238,126 | 12/1980 | Langdon | 271/3.1 |

*Primary Examiner*—Richard A. Schacher

*Attorney, Agent, or Firm*—Biebel, French & Nauman

[57] ABSTRACT

A device for inverting a sheet includes an input and output transport means and a sheet receiving tray. Sheet deflectors are provided to deflect portions of a sheet as it leaves the input transport means and moves into the tray. A reversal drive arrangement, including a drive roller within a vacuum plenum, contacts a sheet supplied to the tray and moves the sheet into engagement with the sheet output transport means. This arrangement adds beam strength to a sheet entering the tray and permits a second sheet to be supplied to the tray prior to complete removal of the previously inverted sheet.

14 Claims, 8 Drawing Figures

SHEET INVERTING DEVICE

BACKGROUND OF THE INVENTION

The present invention relates to a sheet handling device and, more particularly, to a device for inverting a sheet carried by a sheet transport conveyor.

Various types of copiers and duplicators are known in which the images from original documents may be copied onto sheets of copy paper. Such copiers and duplicators may use xerographic copying techniques or, alternatively, may reproduce the images from the original documents by ink jet printing or other printing techniques. Commonly, an original document may have an image on both sides of the document and it may be desired to produce copies of the document in which these images are reproduced on opposite sides of the sheets of copy paper. After a sheet of paper has been printed with an image on a first side of the sheet, as the sheet is transported on a conveyor past a printing station, it is necessary to invert the sheet of paper on the conveyor prior to transporting the sheet past the printing station for printing on the opposite side of the sheet. Alternatively, after the sheet is inverted, it may be transported past a second printing station for printing the second side of the sheet.

A number of devices have been developed which perform this sheet inversion process. One such device is shown in Reesen U.S. Pat. No. 4,214,831. The Reesen patent discloses a xerographic copier in which a sheet of copy paper is applied to a photosensitive belt and transported part a first transfer station to transfer an image from the belt onto the sheet. The sheet of paper is then diverted from the belt onto a guide member by means of vacuum rollers cooperating with and spaced along the guide member. After the sheet has been completely removed from the belt, the direction of rotation of the vacuum rollers is reversed and the sheet returned to the belt such that the edge of the sheet which was previously the trailing edge now becomes the leading edge. The belt then carries the sheet past a second image transfer station and a second image is transferred to the opposite side of the sheet. The sheet is thereafter removed from the belt, the images on both sides of the sheet are fixed simultaneously, and the sheet is transported to a copy paper output tray. While the Reesen device is useful in the limited environment of a xerographic belt copier, the inverter device is somewhat limited in possible applications in that successive sheets carried by the belt must be widely spaced apart in order to provide sufficient time for a sheet to be removed completely from the sheet guide and returned to the belt prior to the application of the next succeeding sheet to the inverter device.

A similar device is disclosed in Caldwell U.S. Pat. No. 3,917,257. The Caldwell patent discloses a sheet inverting arrangement having a vacuum transport which receives sheets stripped from a conveyor. After a sheet has been completely removed from the conveyor and is positioned on the vacuum transport, the direction of movement of the vacuum transport is reversed so that the sheet is reapplied to the conveyor with the trailing edge of the sheet becoming the leading edge. As with the Reesen device, the device disclosed in the Caldwell patent is limited in the speed at which it can invert sheets in that a sheet must be completely removed from the inverter prior to the application of the next successive sheet to the inverter. Additionally, the Caldwell inverter requires that a mechanically actuated deflector finger assembly be moved into contact with the sheet at its leading edge to deflect the sheet away from the conveyor. It will be appreciated that where such an inverter is utilized to deflect the leading edge of a sheet which is still somewhat wet from a first printing operation, damage to the leading edge of the sheet may occur.

Stange et al U.S. Pat. No. 4,054,285, and Acquavive U.S. Pat. No. 4,214,740 disclose generally similar sheet reversing devices in which a sheet is transported into a thin rectangular sheet receiving pocket by a roller arrangement. The document is then withdrawn from the pocket by the roller arrangement such that the leading edge of the sheet emerging from the pocket is the edge that was trailing during insertion. There is a suggestion that movement of a sheet within the rectangular pocket may be controlled pneumatically.

Additionally, the Acquaviva patent discloses a roller arrangement for withdrawing a sheet from the pocket which corrugates the sheet in a direction perpendicular to its movement such that the beam strength of the sheet is increased. The sheet therefore does not tend to be carried around the sheet driving rollers. The Acquaviva and Stange et al devices are limited in that a sheet must be completely removed from the rectangular pocket before the next successively presented sheet may be inserted into the pocket. Additionally, the leading edge of a sheet moving into the pocket strikes the end of the pocket and, as a consequence, the leading edge of a sheet may be damaged.

Clarkson et al U.S. Pat. No. 4,040,616 discloses a sheet inverting device in which a sheet traveling on a vacuum belt is transported downward around a roller until the leading edge of the sheet encounters a crescent-shaped reflector. The sheet of paper is peeled away from the belt and travels upward along the crescent-shaped deflector until it is completely removed from the belt. As a result of gravity, the sheet then slides back down the crescent-shaped deflector and is reapplied to the belt with the edge which was formerly leading becoming the trailing edge of the sheet. As with the previously discussed prior art inverter devices, the Clarkson et al inverter is limited in the speed at which it can handle the inversion of successively presented sheets.

As may be appreciated, it is desirable to provide a mechanism for inverting an original document for a copying device capable of duplex copying an original document having images on both sides. One such device is shown in Burton et al U.S. Pat. No. 4,052,128. In the Burton device, a belt transport is provided for positioning a document at a station where it is photographed. Thereafter, the transport conveys the document to a closed loop vacuum belt inverter. The document is pneumatically lifted from the transport and is carried around the belt inverter. The document is then reapplied to the transport which conveys the document back to the photographing station with its opposite side facing upward. The Burton et al device is rather cumbersome and also requires careful control of the transport and inverting belt system and appropriate timing of the application of partial vacuum and pressurized air to a number of vacuum plenums. Further, the transport must be driven repeatedly in both directions.

Accordingly, it is seen that there is a need for a simple sheet inverter device which is capable of handling the inversion of a succession of sheets at a high rate of speed, with the sheets being presented rapidly to the inverter device.

SUMMARY OF THE INVENTION

A device for inverting a sheet includes a sheet input transport means for transporting a sheet along an input path, and a sheet output transport means for transporting a sheet along an output path extending beneath the input path in a direction generally opposite to the input path. A sheet supporting surface is defined intermediate the input and output paths and is positioned for receiving a sheet which has been discharged by the sheet input transport means. A reversal drive means engages a sheet deposited on the surface by the sheet input transport means and moves the sheet into engagement with the output transport means. A deflector means is positioned adjacent the sheet input transport means for deflecting a portion of a sheet transported by the sheet input transport means. The sheet is distorted by the deflector means into a nonplanar shape to provide beam strength for the sheet as it leaves the sheet input transport means.

The input path may be inclined downward with respect to the sheet supporting surface. The sheet supporting surface and the output path may be inclined with respect to the input path. The input and output paths preferably define an included angle therebetween of approximately $6\frac{3}{4}°$ to 18°.

The reversal drive means may include means defining an opening in the surface, roller means mounted in the opening for contacting the lower surface of a sheet supported on the surface, and means for supplying a partial vacuum to the opening to hold a sheet against the roller means. The reversal drive means may further include means for rotating the roller means in a direction such that a sheet engaged thereby is transported toward the sheet output transport means.

The device may further include means defining at least one vacuum port in the surface and means supplying a partial vacuum to the vacuum port, whereby movement of a sheet on the surface over the vacuum port is retarded by the partial vacuum. A plurality of such vacuum ports may be provided in the surface with a partial vacuum supplied to each of the vacuum ports. A sheet retarding roller may be mounted in each of said vacuum ports and connected to a clutch arrangement which permits free rotation of said braking wheels as said sheet is transported toward the sheet output transport means, while preventing rotation of the braking wheel in the opposite direction.

The deflector means may include a pair of sheet contacting members, each such member defining a sheet contacting edge raised at least approximately $\frac{1}{4}$ inch above said input path. The sheet contacting edges are positioned to contact a sheet adjacent opposite lateral edges thereof so as to deflect the lateral edges of the sheet out of the input path.

The device may further include a pair of side walls positioned on opposite sides of the surface and extending substantially parallel to the output path. The side walls are inclined such that they converge toward the surface to position a sheet laterally as the sheet moves onto the surface.

A method of inverting a sheet according to the present invention comprises the steps of:

(a) providing a sheet supporting tray having a first end thereof open to receive a sheet and to permit subsequent removal of the sheet therefrom;

(b) moving a sheet along an input sheet path towards the first end of the tray while supporting the sheet in a plane parallel to the direction of movement of the sheet until the sheet extends over the tray at the first end of the tray;

(c) deflecting a portion of the sheet out of the plane as the sheet extends over the tray so as to provide the sheet with beam strength; and (d) thereafter, removing the sheet from the first end of the tray in a direction substantially opposite to the direction of movement of the sheet into the tray.

The step of deflecting a portion of the sheet may include the step of deflecting the lateral edges of the sheet generally upward to curve the sheet laterally thereacross.

The method may further comprise the step of supplying a partial vacuum to an opening in the tray adjacent the first end thereof for attracting the trailing edge of the sheet to the tray as the sheet leaves the input sheet path. The step of removing the sheet from the first end of the tray may include the step of rotating one or more rollers mounted in the opening such that the sheet contacts the roller or rollers and is transported out of the first end of the tray.

The method may also include the step of supplying a partial vacuum to a port in the tray remote from the first end thereof to attract the leading edge of the sheet to the tray as the sheet leaves the input sheet path.

Accordingly, it is seen that it is an object of the present invention to provide a device and method for inverting a sheet in which the sheet is deflected into a nonplanar shape as it leaves a sheet transport and passes into a sheet receiving tray, thereby providing the sheet with beam strength; to provide such a device and method in which a reversal arrangement is provided for transporting a sheet out of the tray; and to provide such a device and method in which sheets may be reversed without a substantial time delay between presentation of successive sheets.

Other objects and advantages of the invention will be apparent from the following description, the accompanying drawings and the appended claims.

DETAILED DESCRIPTION OF THE PREFERRED EMBODIMENT

Figure 1:
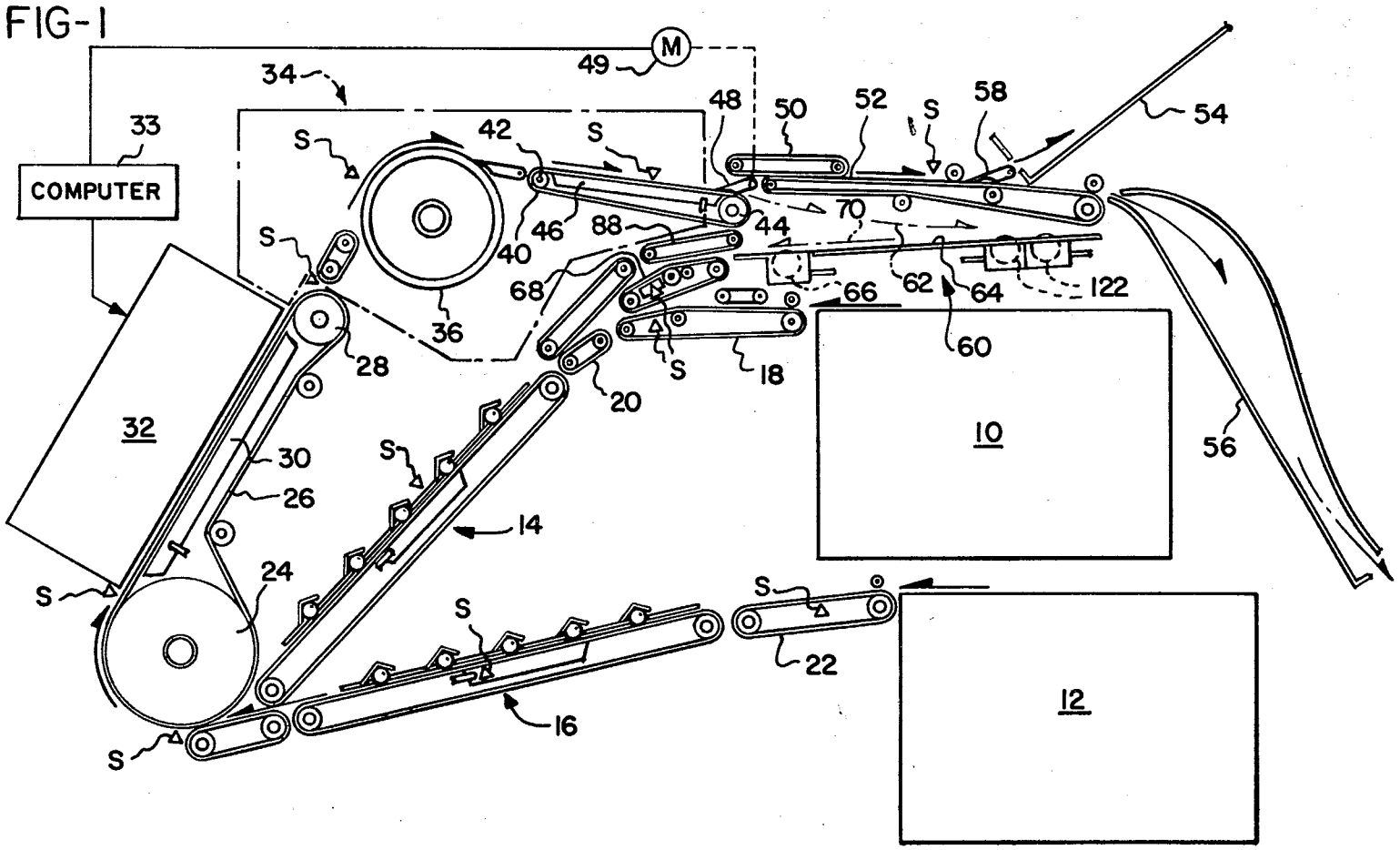
FIG. 1 is a side view of a printing system including the sheet inverting device of the present invention.

FIG. 1 is a schematic representation of a sheet inverting device constructed according to the present invention, and incorporated in a printing system. A pair of paper supply stations 10 and 12 provide blank sheets of paper to associated sheet feed and alignment sections 14 and 16, respectively. Sheets of paper from supply station 10 are supplied to sheet feed and alignment section 14 via transport belts 18 and 20, while sheets from supply station 12 are transported to sheet feed and alignment section 16 by belt transport 22. Sheets are shifted laterally as they are transported through alignment sections 14 and 16 to provide lateral alignment prior to presentation of the sheets to a vacuum drum 24. Belts 26 extend around drum 24 and roller 28 and pass over vacuum plenum 30. Sheets supplied to drum 24 are carried on the belts 26 past a printer 32, which may advantageously be an ink jet printer. The printer 32 operates in response to print control signals supplied by computer 33 or, alternatively, by a document scanner. Print control signals may alternatively be provided from a document scanner or other similar device. Computer 33 also monitors movement of sheets of paper through the paper path by means of photodetectors S spaced along the paper path.

After printing on a first side of a sheet, the sheet is delivered to a drying station 34 where the ink on the sheet is dried as it is carried by drum 36 to belts 40. The sheet is then delivered to the sheet input transport means which transports the sheet along an input path of the sheet inverter. The sheet input transport means includes belts 40, which extend around rollers 42 and 44, and a vacuum plenum 46 to which a partial vacuum is applied. In the case of sheets which are to be printed in a simplex mode, that is, printed only on one side, these sheets are removed from the sheet input transport belts 40 by gate 48 which is pivoted downward into the position shown in FIG. 1 by actuator 49. Gate 48 strips the sheets from belt 40 and delivers them to a conveyor mechanism, including belts 50 and 52, which delivers the sheets to an output sample tray 54 or to an accumulator tray 56. Gate 58 is provided to deflect the sheets into tray 54 when pivoted into the position shown in FIG. 1.

If the second side of a sheet is to be printed to produce a duplex copy having print images on both of its sides, the sheet is supplied to sheet inverter 60, as indicated by arrow 62, such that the sheet is received on a sheet supporting surface 64. The sheet is then engaged by a reversal drive means including drive rollers 66, and moved toward an output transport means including belts 68, as indicated by arrow 70. The sheet inverter device of the present invention is described more completely below.

Having been inverted and delivered to the sheet output transport means which transports the sheet in a direction generally opposite to the input path, the inverted sheet is then transported through the sheet feed and alignment section 14 where it is again laterally aligned. Note that at this point the side of the sheet which has previously printed is generally facing upward. As the sheet reaches vacuum drum 24, the previously printed side of the sheet contacts the drum 24 and belts 26. The sheet is transported around the drum 24 and makes a second printing pass beneath ink jet printer 32. It will be appreciated that during this second pass the second, unprinted side of the sheet is facing the printer and a print image may be printed thereon. After the second side of the sheet is printed, the sheet passes through the dryer section 34 and is subsequently delivered either to sample copy tray 54 or output accumulator tray 56.

Figure 2:
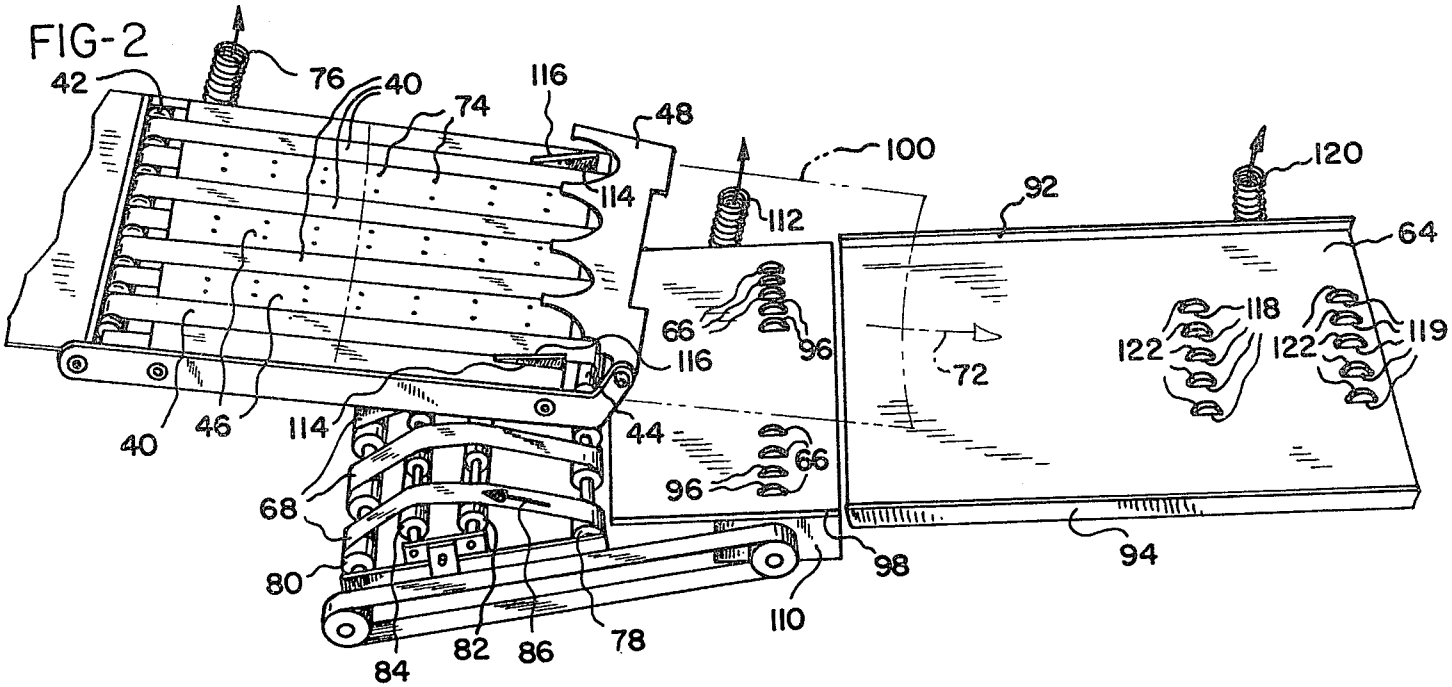
FIG. 2 is a perspective view of the sheet inverting device, showing delivery of a sheet thereto.
Figure 3:
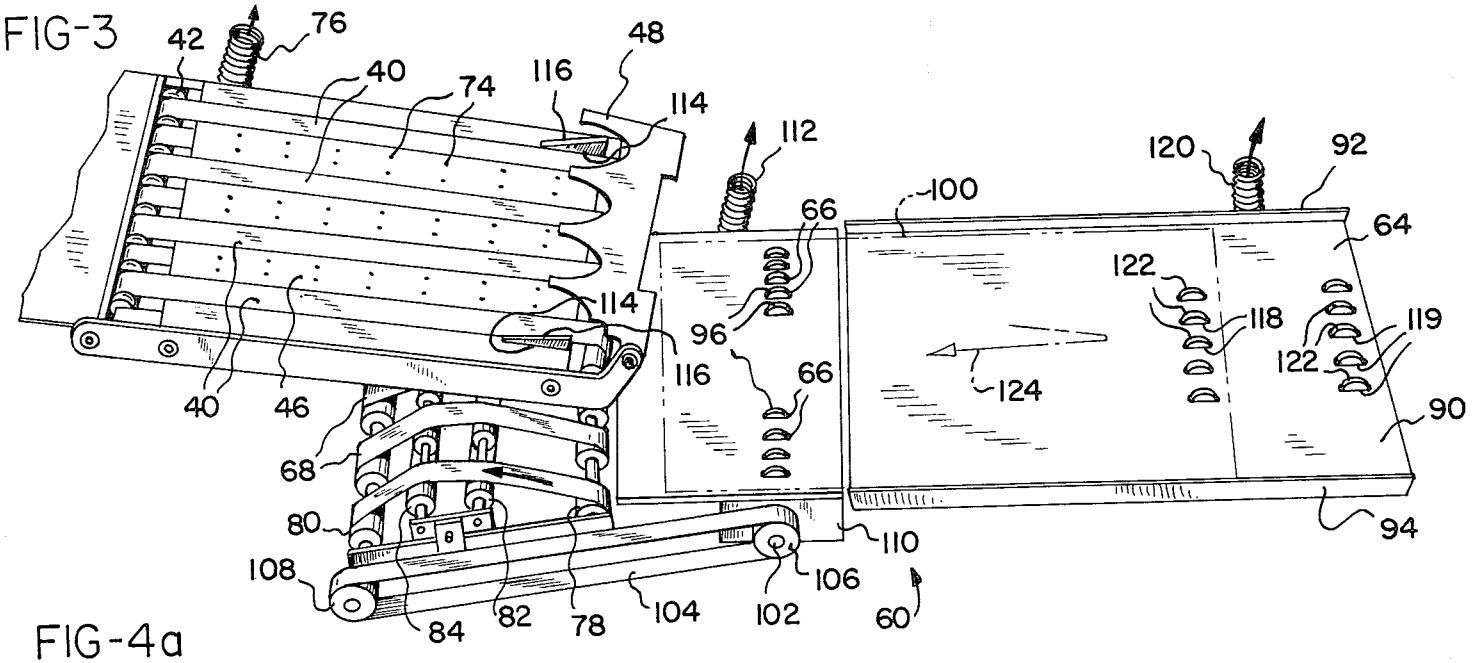
FIG. 3 is a perspective view of the sheet inverting device, illustrating inversion of a sheet; and FIGS. *4e–4e* are views of the sheet inverting device, similar to FIG. 1, illustrating its method of operation.
Figure 4A:
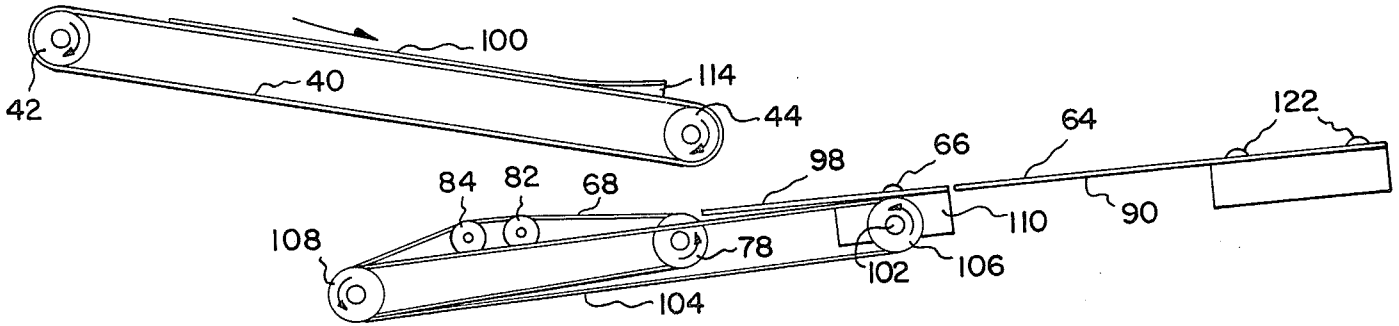
Figure 4B:
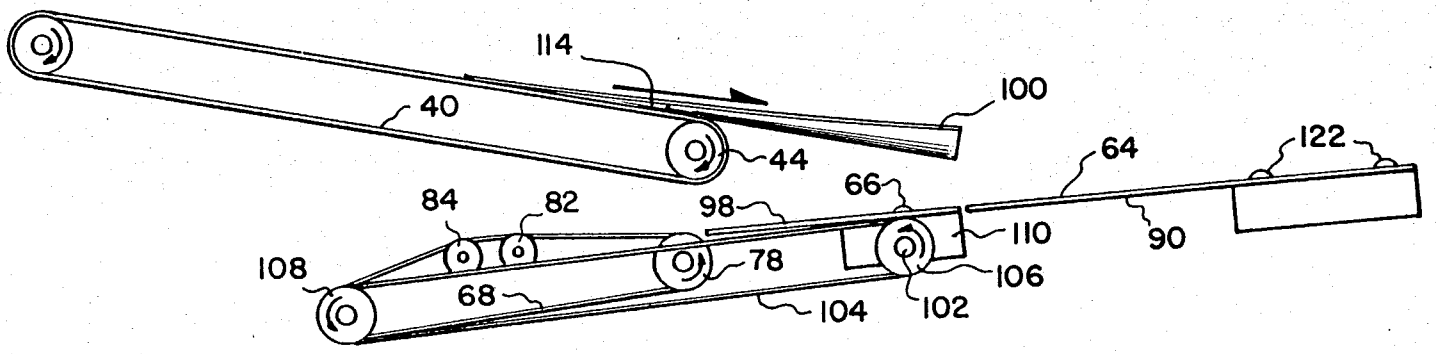
Figure 4C:
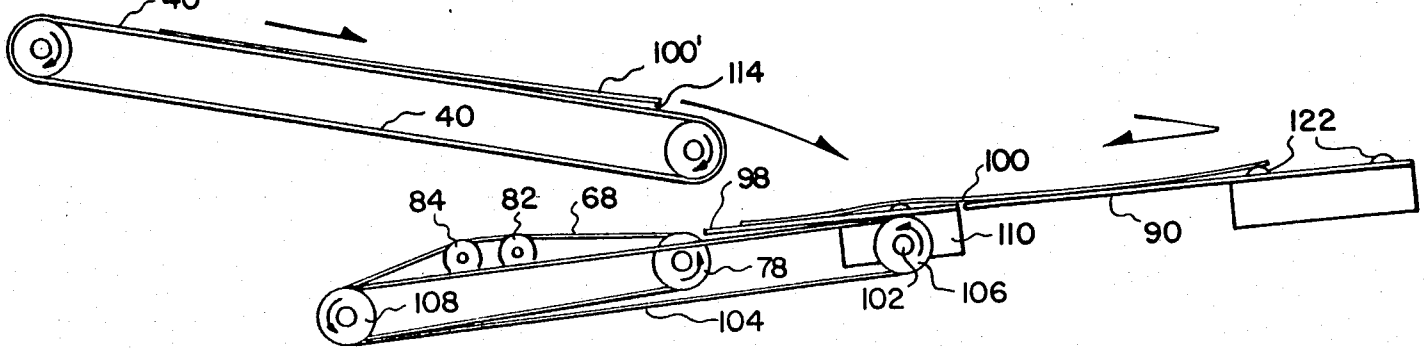
Figure 4D:
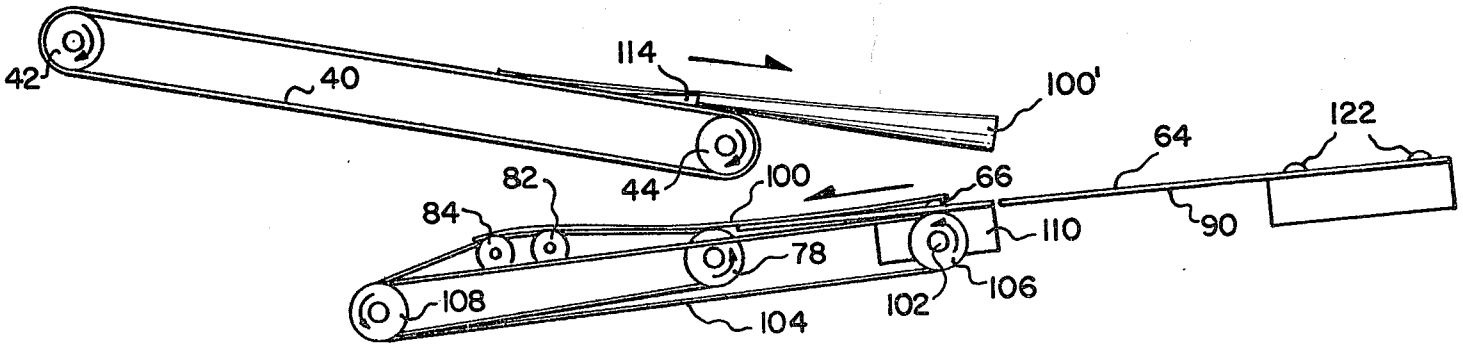
Figure 4E:
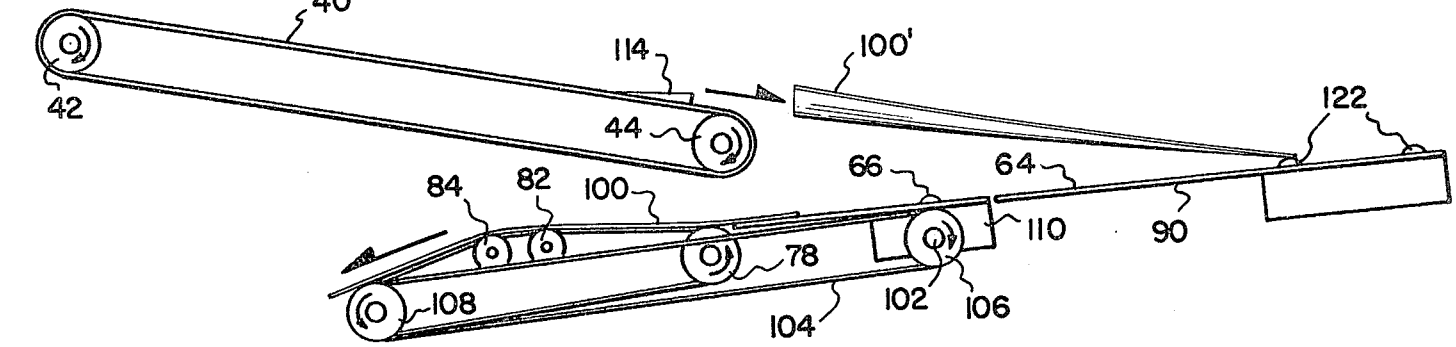

Reference is made to FIGS. 2 and 3 which illustrate the sheet inverting device of the present invention in greater detail. A sheet input transport is provided for transporting a sheet along an input path in a direction indicated by arrow 72. The sheet input transport means includes belts 40, extending between rollers 42 and 44, which cooperate with vacuum plenum 46. Plenum 46 defines a plurality of holes 74 between the belts and receives a partial vacuum supplied thereto via vacuum line 76. The partial vacuum draws sheets downward against belts 40 so that the sheets are engaged by the belts and move therewith.

A sheet output transport means includes belts 68 which extend around rollers 78, 80, 82, and 84, for transporting a sheet along an output path in the direction of arrow 86. The direction of the output path is generally opposite to and extends beneath the direction of the input path. A sheet may be held against belts 68 by belts 88 (FIG. 1), which have been removed from FIGS. 2 and 3 for purposes of clarity of illustration. Belts 68 are driven by an appropriate drive means (not shown) connected to rollers 80.

Positioned adjacent the sheet input transport means and the sheet output transport means is a sheet supporting tray 90 which defines the sheet supporting surface 64 and which includes a pair of side walls 92 and 94. Walls 92 and 94 are positioned on opposite sides of the surface 64 and extend substantially parallel to the output path. If desired, the side walls 92 and 94 may be inclined by an angle of approximately 5° with respect to vertical such that they converge toward surface 64. The side walls therefore tend to position a sheet laterally as the sheet moves onto surface 64, as more fully described below.

The reversal drive means preferably includes rollers 66, the tops of which are slightly above the level of surface 64. The rollers 66 engage a sheet deposited on surface 64 by the sheet input transport means and move the sheet into engagement with the sheet output transport means, including moving belts 68. Rollers 66 are mounted in openings 96, defined by plate 98. Plate 98 defines a portion of surface 64 and rollers 66 contact the lower surface of a sheet 100 supported on surface 64. Rollers 66, preferably formed of an elastomeric material, are mounted to be driven by shaft 102. Shaft 102 is driven by belt 104 extending between pulleys 106 and 108. As a consequence, rollers 66 are driven in synchronism with belts 68 which form a portion of the output transport means.

Plate 98 defines the top of a vacuum plenum 110 to which a partial vacuum is supplied via vacuum line 112. This partial vacuum forces a sheet on surface 64 downward for secure engagement by rollers 66; as a consequence, a sheet on surface 64 is engaged by rollers 66 without the need for opposing pinch rollers. If desired, a vacuum roller of the type defining a plurality of holes in its surface, and having a partial vacuum supplied to an internal roller cavity, may be substituted for the rollers 66.

A deflector means, comprising a pair of sheet contacting members 114, is mounted on the top of plenum 46 and deflects a portion of the sheet 100 transported by the input transport means. As described more fully below, the deflector means distorts the sheet into a nonplanar shape to provide beam strength for the sheet. Each of the members 114 defines a sheet contacting edge 116 which is inclined in an angle, such as 5°, to the direction of sheet movement along the input path. The edges 116 are positioned to contact a sheet adjacent opposite lateral edges as the sheet moves along the input path.

The input path of the sheet along the sheet input transport means is inclined downward with respect to the sheet supporting surface 64. The sheet supporting surface is inclined approximately $6\frac{3}{4}°$ with respect to horizontal. Additionally, the input path is inclined approximately $6\frac{3}{4}°$ with respect to horizontal. As a consequence, the input path and the output path define an included angle therebetween of approximately 13½°. If the sheet path were other than as shown in FIG. 1, the sheet supporting surface and the input path could be oriented at different angles with respect to horizontal, as long as they defined an angle of approximately 13½° therebetween. It has been found that the device of the present invention operates best when the included angle is in the range of 6¾° to 18°. This range may, however, be altered, if the length of the sheets being inverted is not approximately 8½–14 inches. Shorter sheets may permit a greater included angle while longer sheets may require a lesser included angle.

A plurality of vacuum ports 118 and 119 in the surface 64 communicate with vacuum plenums to which a partial vacuum is supplied via vacuum line 120. As a sheet of paper moves onto surface 64, its leading edge passes over vacuum ports 118 and 119. A partial vacuum is applied through ports 118 when 11 inch paper is used, while the partial vacuum is applied through ports 119 when 14 inch paper is being printed. Movement of the sheet is retarded by the application of a partial vacuum to the bottom surface of the sheet. In order to provide further retardation of the movement of a sheet as the sheet moves onto the surface 64, a plurality of elastomeric rollers 122 are mounted such that they extend partially through the openings 118 and 119, slightly above the level of surface 64. Rollers 122 are connected to unidirectional clutch mechanisms which permit them to rotate freely generally counterclockwise, as seen in FIGS. 2 and 3, but prevents clockwise rotation of the rollers. As a consequence, movement of a sheet 100 to the right as seen in FIGS. 2 and 3 is limited when the sheet is engaged by the rollers 122, but movement of a sheet to the left, as indicated by arrow 124 in FIG. 3, is freely permitted. It will be appreciated that since the sheet is not stopped by engaging its leading edge with a mechanical stop mechanism, damage to the leading edge is avoided even when handling a sheet which is still somewhat damp from a printing operation.

The method of sheet inversion of the present invention is illustrated in FIGS. *4a–4e*. The side walls 92 and 94 have been removed from the tray 90 in FIGS. *4a–4e* for purposes of clarity in illustrating the operation of the device. As seen in FIG. *4a*, a sheet 100 which has been previously printed on the top surface thereof is supplied by the sheet input transport means to the inverter device. The sheet 100 moves along the sheet input path toward the tray 90, while supported in a plane parallel to the direction of movement by the vacuum belt transport arrangement including belts 40.

The lateral edges of the sheet 100 are deflected upward by members 114 as the sheet moves over the edges 116 such that it is distorted into a nonplanar, generally curved cross-sectional configuration. As seen in FIG. *4b*, deflecting sheet 100 out of its plane of movement as it extends over the tray 90 provides the sheet with beam strength. This prevents the sheet 100 from bending in a direction perpendicular to its direction of movement as it passes out over the roller 44, unsupported by the belts 40. It will be appreciated that the lateral edges of the sheet must be deflected sufficiently to provide this deflection. For this purpose the members 114 extend upward by approximately ¼ inch above the level of belts 40. If desired, greater sheet deflection may be provided, although this may require increased clearance above the sheet input path to permit passage of the distorted sheet.

As the leading edge of the sheet 100 contacts the surface 64, and the sheet continues to move off of the sheet input transport means, the leading edge of the sheet covers openings 118 or 119 and contacts rollers 122 extending through the covered openings. Because of the clutch mechanisms to which they are attached, rollers 122 do not rotate in a clockwise direction as seen in FIGS. *4a–4e*. As a result of the friction between the sheet 100 and the rollers 122, further movement of the sheet after it has left the input transport means is prevented.

As the trailing edge of the sheet 100 leaves the vacuum belt transport, the edge drops down onto the surface 64 in a position illustrated in FIG. *4c*. It will be appreciated that the rate at which the trailing edge of sheet 100 falls onto surface 64 is a function of the weight and stiffness of the sheet and, also, of the partial vacuum supplied to the plenum 110 via vacuum line 112.

Rollers 66 are rotated by pulley 106 mounted on shaft 102. Rotation of the rollers 66 occurs continuously in a counterclockwise direction as seen in FIG. *4c*. As a consequence, as soon as the trailing edge of sheet 100 contacts the rollers 66 and is pulled against the rollers by the partial vacuum in plenum 110, the sheet is driven to the left, toward the belts 68. Simultaneously, the next successively presented sheet 100', shown in FIG. *4c*, travels along the input path and contacts members 114. Since the beam strength of sheet 100' is substantially increased by deflecting it into a curved cross-sectional shape as shown in FIG. *4d*, sheet 100' can be moved into tray 90 before sheet 100 is completely removed from the tray without any contact between sheets 100 and 100'.

As sheet 100 is moved out of tray 90, it is engaged by the output transport means, including belts 68, as shown in FIG. *4e*. It should be noted that sheet 100 is positioned on belts 68 with its previously printed side facing upward. As a result, when the sheet 100 is transported downward through the registration section 14 (FIG. 1) and passes around vacuum drum 24, this printed side of the sheet will be in contact with drum 24 and the unprinted side of the sheet then will be facing printer 32. As a consequence, the second side of the sheet may then be printed.

If the spacing between two sheets successively presented for inversion is undesirably close, the inverter device of the present invention tends to separate the sheets apart as they leave the inverter along the sheet output path. As seen in FIG. *4d*, the trailing edge of a sheet 100 covers the vacuum openings 96 during at least a portion of the time during which the next successive sheet 100' is supplied to tray 90. The closer together the sheets 100 and 100', the longer the time during which sheet 100 covers openings 96 as sheet 100' means into tray 90. As a consequence, the time required for the trailing edge of the second sheet 100' to fall onto the rollers 66 increases as the spacing between sheets 100 and 100' decreases. Therefore, a substantially increased time for the trailing edge of sheet 100' to fall onto rollers 66, resulting from too close a spacing between sheets 100 and 100', allows a substantially greater period of time for the sheet 100 to travel away from the inverter device along the outut path before the sheet 100' is supplied to the output path. The spacing between the two successive sheets is therefore increased.

It should be noted that the present invention is configured such that no mechanical paper stops are needed for registering either the leading or trailing edges of the sheets as they are reversed. As a consequence, handling of wet sheets is facilitated and the likelihood that the edges of the sheets will be damaged during the inverting process is substantially reduced. Additionally, successively inverted sheets may be spaced very closely apart without coming into contact with each other during inversion.

While the method herein described, in the form of apparatus for carrying this method into effect, constitutes preferred embodiments of the invention, it is to be understood that the invention is not limited to this precise method and form of apparatus, and that changes may be made in either without departing from the scope of the invention.

What is claimed is:

1. A device for inverting a sheet, comprising:

sheet input transport means for transporting a sheet along an input path, sheet output transport means for transporting a sheet along an output path in a direction generally opposite to said input path, said output path extending beneath the input path, means defining a sheet supporting surface intermediate said input and output paths and positioned for receiving a sheet which has been discharged by said sheet input transport means, sheet retarding roller means mounted on said means defining a sheet supporting surface such that said roller means extends partially through said surface to contact a sheet supported on said surface, said sheet retarding roller means being mounted for rotation in a first direction so as not to inhibit movement of a sheet on said sheet supporting surface toward said output path, while not being mounted for rotation in a second direction, opposite to said first direction, so as to inhibit movement of a sheet on said sheet supporting surface toward said output path, reversal drive means for engaging a sheet deposited on said surface by said sheet input transport means, and for moving said sheet into engagement with said sheet output transport means, and deflector means, adjacent said sheet input transport means, for deflecting a portion of a sheet transported by said sheet input transport means, whereby said sheet is distorted into a nonplanar shape to provide beam strength therefor as said sheet leaves said sheet input transport means.

2. The device of claim 1 in which said input path is inclined downward with respect to said sheet supporting surface.

3. The device of claim 1 in which said surface is aligned with said output path.

4. The device of claim 2 in which said input path and said sheet supporting surface define an included angle therebetween in the range of approximately $6\frac{3}{4}°$ to 18°.

5. The device of claim 4 in which said included angle is approximately $13\frac{1}{2}°$.

6. The device of claim 1 in which said reversal drive means comprises:

means defining an opening in said surface, roller means mounted in said opening for contacting the lower surface of a sheet supported on said sheet supporting surface, means for supplying a partial vacuum to said opening to hold a sheet against said roller means, and means for rotating said roller means in a direction such that a sheet engaged thereby is transported toward said sheet output transport means.

7. The device of claim 1 in which said deflector means comprises a pair of sheet contacting members, each such member defining a sheet contacting edge inclined at an angle to the direction of sheet movement along said input path, said edges being positioned to contact opposite lateral edges of a sheet moving along said input path so as to deflect said lateral edges of said sheet.

8. The device of claim 7 in which each of said sheet contacting edges is inclined to the direction of sheet movement along said input path.

9. The device of claim 1 further comprising a pair of side walls positioned on opposite sides of said surface and extending substantially parallel to said output path, said side walls being inclined such that they converge toward said surface to position a sheet laterally as said sheet moves onto said surface.

10. The device of claim 1 in which said sheet retarding roller means comprises:

means defining at least one vacuum port in said surface, a roller, mounted in said vacuum port, and clutch means, operatively connected to said roller, to permit rotation of said roller only in a first direction, whereby movement of a sheet on said surface toward said output path is freely permitted but movement of a sheet on said surface in the opposite direction is resisted.

11. The device of claim 10 further comprising a partial vacuum source, connected to said sheet retarding roller means, for supplying a partial vacuum to said vacuum port such that a sheet on said surface is drawn against said roller.

12. The device of claim 1 in which said sheet retarding roller means comprises:

means defining a plurality of vacuum ports in said surface, a plurality of rollers, each such roller being mounted in an associated one of said plurality of vacuum ports so as to extend slightly above said surface and contact a sheet on said surface, and clutch means, operatively connected to said rollers, to permit rotation of said rollers only in a first direction, whereby movement of a sheet on said surface toward said output is freely permitted but movement of a sheet on said surface in the opposite direction is resisted.

13. The device of claim 12 in which said vacuum ports are arranged in a pair of rows, said rows being generally perpendicular to the movement of a sheet and spaced so as to engage sheets of differing lengths adjacent their leading edges as said sheets are delivered to said sheet supporting surface by said sheet input transport means.

14. A device for inverting a sheet, comprising:

a vacuum transport for transporting said sheet along an input path of generally horizontal extent, sheet output transport means positioned below said vacuum transport, a receiving tray positioned intermediate said vacuum transport and said output transport for receiving said sheet from said vacuum transport and transferring it to said output transport means, a reversely driven vacuum roller for transferring said sheet from said receiving tray to said output transport means, a pair of deflector members positioned on said vacuum transport for deflecting the sides of said sheet upwardly away from said vacuum transport and causing said sheet to be propelled forwardly and downwardly toward said receiving tray, and a plurality of sheet retarding rollers, mounted in vacuum openings in said tray, for engaging a sheet adjacent its leading edge as the sheet is propelled into contact with said tray and causing the sheet to come to rest on the tray prior to the transfer of the sheet to the output transport means.

* * * * *